US008820210B2

(12) United States Patent
Melville

(10) Patent No.: US 8,820,210 B2
(45) Date of Patent: Sep. 2, 2014

(54) FIREARM CHARGING HANDLE

(71) Applicant: Jason S. Melville, Phoenix, AZ (US)

(72) Inventor: Jason S. Melville, Phoenix, AZ (US)

( * ) Notice: Subject to any disclaimer, the term of this patent is extended or adjusted under 35 U.S.C. 154(b) by 38 days.

(21) Appl. No.: 13/648,178

(22) Filed: Oct. 9, 2012

(65) Prior Publication Data

US 2013/0192113 A1 Aug. 1, 2013

Related U.S. Application Data

(60) Provisional application No. 61/545,589, filed on Oct. 11, 2011.

(51) Int. Cl.
*F41A 9/66* (2006.01)

(52) U.S. Cl.
USPC ..... 89/1.4; 42/69.01

(58) Field of Classification Search
CPC ..... F41A 3/72; F41A 35/06; F41A 19/34
USPC ..... 89/1.4; 42/87, 69.01
See application file for complete search history.

(56) References Cited

U.S. PATENT DOCUMENTS

| | | | | |
|---|---|---|---|---|
| 7,861,635 | B1 | 1/2011 | Hoel | |
| 2011/0005117 | A1 | 1/2011 | Bordson | |
| 2011/0214558 | A1 | 9/2011 | Kincel | |
| 2011/0226120 | A1 * | 9/2011 | Fitzpatrick et al. | 89/1.4 |

* cited by examiner

*Primary Examiner* — Samir Abdosh
*Assistant Examiner* — John D Cooper
(74) *Attorney, Agent, or Firm* — Thomas W. Galvani P.C.; Thomas W. Galvani

(57) ABSTRACT

A charging handle for a firearm includes a fixture and a lever mounted for pivotal movement to the charging handle. The fixture is pivoted to the charging handle for movement between a first, locked position, and a second, unlocked position. The lever is pivoted to the fixture for movement between first and second positions. In the first position of the lever and the first position of the fixture, the lever is stored proximate to the firearm in a low-profile arrangement. In the second position of the lever and the first position of the fixture, the lever is coupled to the fixture to move the fixture into the second position. In the second position of the lever and the second position of the fixture, the lever is deployed outward from the firearm and is available to be retracted backward so as to cycle the charging handle.

18 Claims, 7 Drawing Sheets

FIREARM CHARGING HANDLE

FIELD OF THE INVENTION

The present invention relates generally to firearms and more particularly to charging handles for firearms.

BACKGROUND OF THE INVENTION

Firearms in the family of rifles including an M-4, M-16, AR-15, and AR-10 have an upper assembly consisting of an upper receiver, a barrel mounted to the upper receiver, and a bolt carrier group and charging handle housed in the upper receiver. The upper assembly may carry iron sights, optics, hand grips, and other accessories.

The charging handle readies the firearm to fire a bullet. The charging handle reciprocates between a forward, ready condition and a retracted condition. When the charging handle is drawn back to the retracted position, the bolt carrier group is drawn into the buffer tube, and when the charging handle is released, the charging handle returns to the forward position, stripping and chambering a bullet in preparation for firing.

Various types of charging handles exist. Most of these charging handles are designed to be operated with a single hand. A latch on the charging handle must be pivoted so as to disengage the charging handle from the upper assembly so that the charging handle can be drawn back to the retracted position. Depressing the latch and retracting the charging handle is very difficult when an operator is wearing gloves or mittens. In some cases, an operator will not be able to use only his free hand to depress the latch and retract the charging handle, and will have to use his shooting hand as well, requiring him to take his finger off the trigger of the firearm. Further complicating operation, optics mounted to the upper receiver can be bulky, leaving little room for the operator to quickly find and depress the latch and retract the charging handle.

Still further, the latch presents a safety concern. A projection formed on the latch often catches on nearby gear or equipment, causing the latch to be inadvertently pivoted and the charging handle then retracted without the operator noticing. This can cause a bullet to be accidentally chambered presenting a serious safety hazard. If the operator does happen to notice the latch caught on gear, he must stop to free the caught latch, being careful not to cycle the charging handle. Pausing to do this at an inopportune time poses a danger to the operator and his fellow operators. All of these problems present time and safety hazards. An improved charging handle is needed.

SUMMARY OF THE INVENTION

A charging handle for a firearm includes a fixture and a lever, both mounted for pivotal movement to the charging handle. The fixture is pivoted to the charging handle for movement between a first, locked position, and a second, unlocked position. The lever is pivoted to the fixture for movement between a first, storage position, and a second, deployed position. In the first position of the lever and the first position of the fixture, the lever is stored proximate to the firearm in a low-profile arrangement. In the second position of the lever and the first position of the fixture, the lever is coupled to the fixture to move the fixture into the second position. In the second position of the lever and the second position of the fixture, the lever is deployed outward from the firearm and is available to be retracted backward so as to cycle the charging handle.

BRIEF DESCRIPTION OF THE DRAWINGS

Referring to the drawings.

DETAILED DESCRIPTION

Figures 1A, 1B, 1C, 1D:
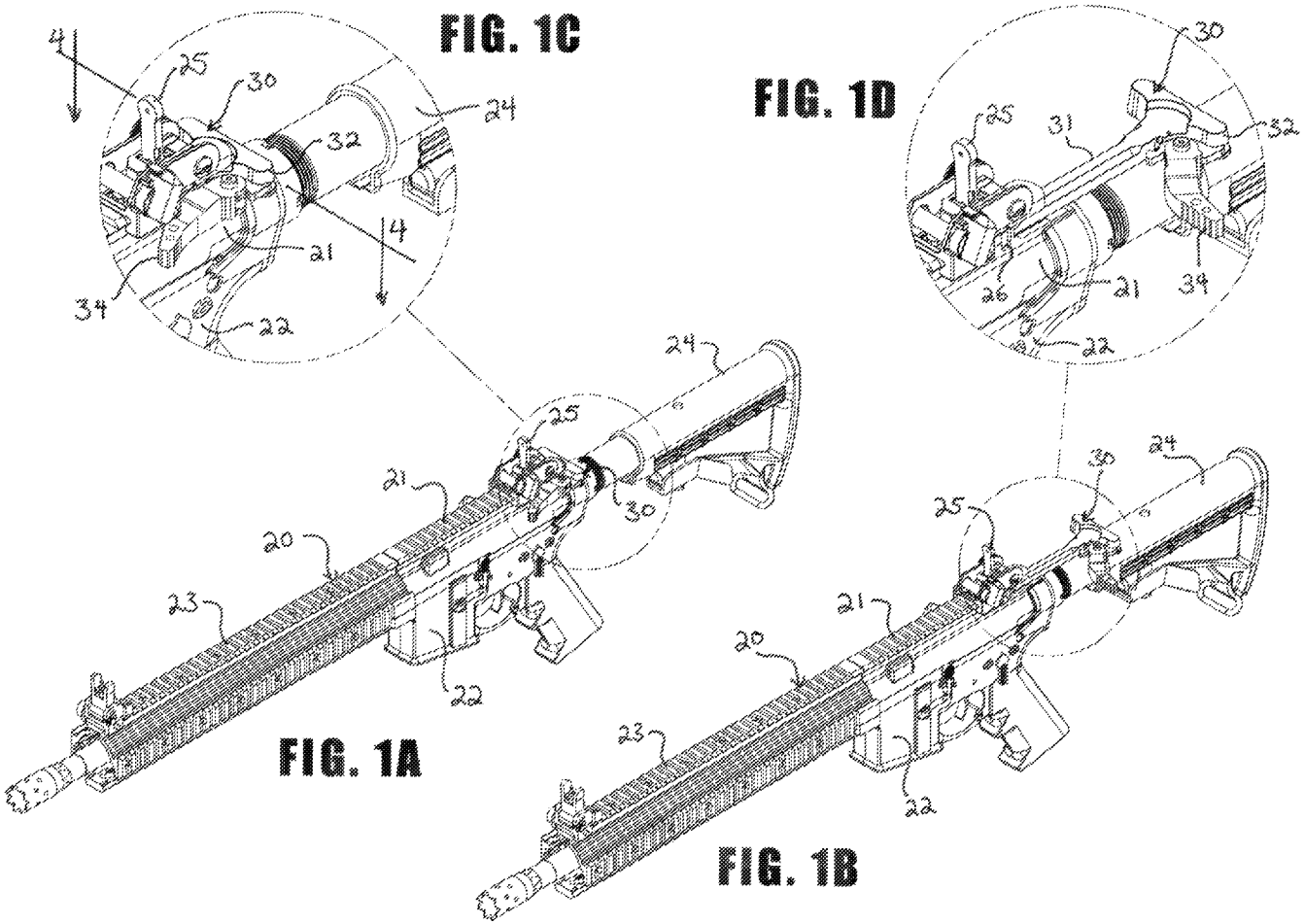
FIG. 1A is a perspective view of a firearm including an upper receiver and a charging handle mounted applied to the upper receiver, the charging handle arranged in a ready condition and having a rail, a head, a fixture, and a lever.
FIG. 1B is a view similar to that of FIG. 1A showing the charging handle in a retracted condition.
FIG. 1C is an enlarged view of FIG. 1A illustrating the charging handle in the ready condition.
FIG. 1D is an enlarged view of FIG. 1B illustrating the charging handle in the retracted condition.
Figure 2A:
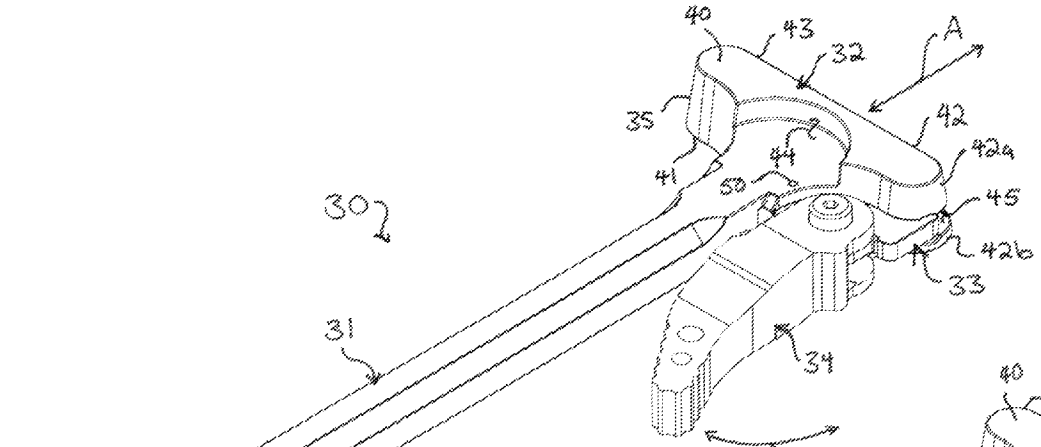
FIGS. 2A and 2B are isolated perspective views of the charging handle of FIG. 1A in the ready and retracted conditions, respectively.
Figure 2B:
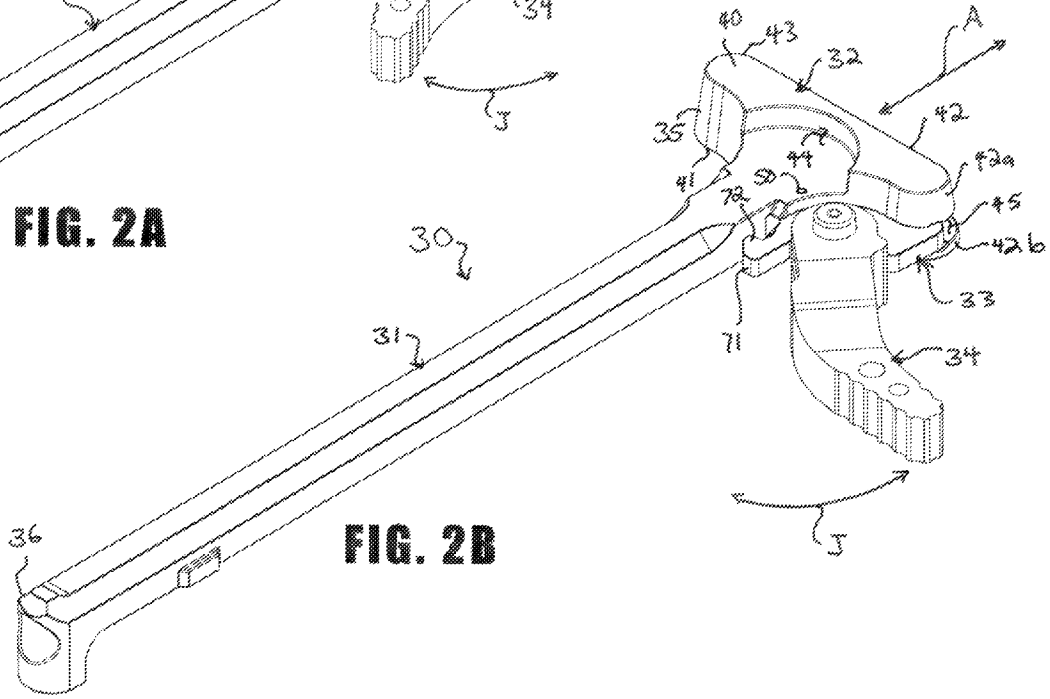

Reference now is made to the drawings, in which the same reference numbers are used throughout the different figures to designate the same components. FIGS. 1A-1D illustrate a rifle or firearm 20 as is typical of the family of rifles including the M-4, M-16, AR-15, and AR-10. The firearm 20 includes an upper receiver 21, a lower receiver 22, and a barrel 23 and stock 24 coupled to opposing ends of the upper receiver 21, and iron sights 25 mounted on the upper receiver 21. FIGS. 1A-1D display a charging handle 30 for use with the firearm 20 to cycle a bolt carrier group (not visible) of the firearm 20 so as to ready the firearm 20 for firing. FIGS. 1A and 1C show the charging handle 30 in a ready condition applied in the upper receiver 21. FIGS. 1B and 1D show the charging handle 30 in a retracted condition partially withdrawn from the upper receiver 21. With reference now to FIGS. 2A and 2B, which illustrate the charging handle in the ready and retracted conditions, respectively, the charging handle 30 includes a rail 31, a head 32 formed on the rail 31, a fixture 33 pivoted to the head 32, and a lever 34 pivoted to the fixture 33.

The head 32 is formed integrally in the rail 31 at a pull end 35 of the rail 31 opposite a tip 36 of the rail 31. The rail 31 includes an elongate body extending between the pull end 35 and the tip 36 for reciprocation within the upper receiver 21 of the firearm along a direction generally indicated by double-arrowed line A in FIG. 2A to cycle the bolt carrier group. The head 32 at the pull end 35 is a handle for grasping the charging handle 30 to pull the charging handle out of the upper receiver 21 and into the retracted condition. The charging handle 30 is biased back into the ready condition in the upper receiver 21 in a conventional and well-known fashion.

The head 32 has an opposed top and bottom 40 and 41, and opposed projecting sides 42 and 43 which extend outwardly from the pull end 35 of the rail 31 in a direction generally perpendicular to the line A along which the charging handle 30 reciprocates. A semi-circular, concave recess 42 is formed between the projections 40 and 41 in the top 43 of the head 32 for receiving the upper receiver 21 of the firearm when the charging handle 30 is within the upper receiver 21. A horizontal slot 45 is formed in the side 42 at a generally intermediate location between the top and bottom 40 and 41 of the side 42. The slot 45 extends into the head 32 to a location generally intermediate between the sides 42 and 43 and 43, severing the side 42 symmetrically to define an upper portion 42*a* and a lower portion 42*b*.

Figure 3:
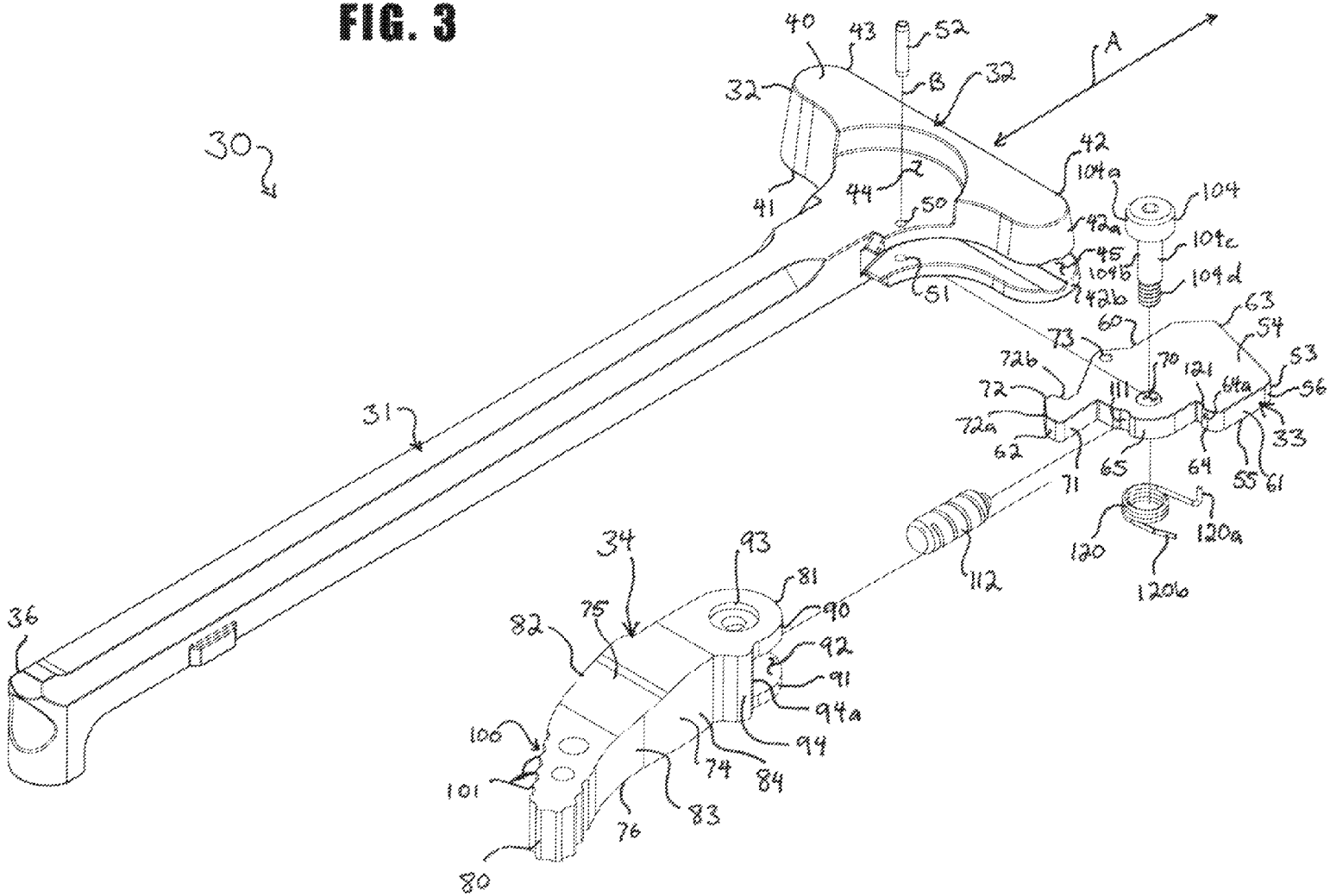
FIG. 3 is an exploded view of the charging handle of FIG. 1, illustrating the rail, head, fixture, and lever.

With reference now to FIG. 3, the fixture 33 is pivoted for movement with respect to the head 32 within the slot 45. Opposed coaxial gudgeons 50 and 51 are carried in the upper and lower portions 42*a* and 42*b* of the side 42, respectively, at the recess 44, for receiving opposed ends of a gudgeon pin 52 about which the fixture 33 pivots. The fixture 33 has a thin, flat body 53 formed with a top surface 54, an opposed and generally parallel bottom surface 55, and a peripheral edge 56 extending about the body 53 between the top and bottom surfaces 54 and 55. The peripheral edge 56 is a sidewall generally perpendicular with respect to the top and bottom surfaces 54 and 55. The fixture 33 has an inner side 60 directed toward the charging handle 30, an opposed outer side 61 directed away from the charging handle, a front 62, and an opposed rear 63. The fixture 33 is constructed from a material or combination of materials having strong, rugged, and rigid material characteristics, such as metal or high density plastic.

An abutment 64 is integrally formed on the fixture 33 proximate to the outer side 61 and projects forwardly from the fixture 33 toward the front 62. The abutment 64 has a contact face 64*a* directed toward the front 62 of the fixture 33. The contact face 64*a* is a planar, vertical face extending across the peripheral edge 56 at the abutment 64 between the top and bottom surfaces 54 and 55. The contact face 64*a* is the most forwardly-directed portion of the abutment 64. The abutment 64 is in a recessed position behind a collar 65 integrally formed between the abutment 64 and the front 62. The peripheral edge 56 around the collar 65 is arcuate and convex, and the collar 65 encircles a smooth bore 70 formed through the body 53 from the top surface 54 to the bottom surface 55. A notch 121 is formed in the peripheral edge 56 between the abutment 64 and the collar 65 and extends inwardly toward the back 63 of the fixture 33.

Still referring to FIG. 3, a latch 71 is integrally formed on the fixture 33 at the front 62 of the fixture 33 proximate to and directed toward the inner side 60 of the fixture 33. A head 72 of the latch 71 is disposed toward the inner side of the fixture 33 on the latch 71, so that the latch 71 catches and engages a catch 26 (shown in FIG. 1D) formed in the upper receiver 21. The head 72 has a front 72*a* that is oblique with respect to the rail 31, and a back 72*b* that is perpendicular with respect to the rail 31.

A bore 73 is carried in the fixture 33, extending from the top surface 54 through to the bottom surface 55, proximate to the inner side 60 at a location generally intermediate the front 62 and rear 62 of the fixture 33. When the fixture 33 is pivoted to the head 32, the bore 73 is aligned with gudgeons 50 and 51 in the upper and lower portions 42*a* and 42*b*, respectively, of the side 42. Gudgeon pin 52 is applied to the gudgeons 50 and 51 and the bore 73 to couple the fixture 33 to the head 32 of the charging handle 30. The gudgeons 50 and 51, the bore 73, and the gudgeon pin 52 cooperate to define a pivot extending along an axis B as indicated by the line B in FIG. 3, about which the fixture 33 pivots with respect to the head 32 of the charging handle 30.

The fixture 33 pivots between a first, locked position and a second, unlocked position about axis B. In the first position of the fixture 30, the head 72 of the latch 71 is proximate to the rail 31, so as to engage the catch 26 of the upper receiver 21 in a lapping engagement when the rail 31 is in the upper receiver 21. With reference to FIG. 1D, in addition to continuing reference to FIG. 3, the catch 26 is an inward depression on the upper receiver 21. With the fixture 33 in the first position, the latch 71 is in a lapping engagement with the catch 26, and the engagement of the latch 71 with the catch 26 prevents the charging handle 30 from being drawn backward along line A toward the stock 24. In the second position of the fixture 33, the head 72 of the latch 71 is away from the rail 31 and the catch 26, so as to release the lapping engagement with the catch 26. With the fixture 33 in the second position, the charging handle 30 can be retracted along line A toward the stock 24 with the latch 72 clearing the catch 26. The fixture 33 is biased from the second position to the first position. A linear compression spring 73 (shown in FIG. 4A) carried in the head 32 perpendicular to the rail 31 exerts an outward force along line C in FIG. 4A in direct contact against the inner side 60 of the fixture 33 proximate to the rear 63, causing the fixture 33 to pivot forwardly about the axis B so that the latch 71 is biased toward the rail 31 and into the catch 26, as shown in FIG. 4A.

Returning to FIG. 3, the lever 34 is pivoted for movement with respect to the fixture 33 at the bore 70 in the fixture 33. The lever 34 includes an elongate and slightly arcuate body 74, a top 75 and an opposed bottom 76, opposed front and rear ends 80 and 81, and opposed inner and outer sides 82 and 83, and a peripheral edge 84 extending about the body 74 between the top and bottom 75 and 76. The lever 34 tapes in height between the top 75 and the bottom 76 from the rear end 81 to the front end 80. The peripheral edge 84 is generally perpendicular with respect to top and bottom 75 and 76. Spaced-apart, projecting tabs 90 and 91 are formed at the rear end 81 of the lever 34 proximate to the top and bottom 75 and 76, respectively, defining a pivot space 92 therebetween extending into the lever 34. A bore 93 extends through the lever 34 at the tabs 90 and 91 inboard of the peripheral edge 84. The bore 93 is smooth at the tab 90 and is threaded at the tab 91. The pivot space 92 defines a fixture-receiving space at which the lever 34 is mounted to the fixture 33 for pivotal movement, and is sized and shaped to receive the portion of the fixture 33 around the collar 65 and bore 70 between the top and bottom surfaces 54 and 55 of the fixture 33. The lever 34 is constructed from a material or combination of materials having strong, rugged, and rigid material characteristics, such as metal or high density plastic.

Proximate to the pivot space 92 on the outer side 83 of the lever 34, the lever 34 carries an abutment 94 formed integrally on the lever 34. The abutment 94 is formed integrally on the lever 34 and projects from the outer side 83 of the lever 34 generally outwardly away from the outer side 83 and generally toward the rear end 81 of the lever 34. The abutment 94 has a contact face 94*a* directed toward the rear end 81 of the lever 34. The contact face 94*a* is a planar, vertical face extending across the peripheral edge 84 at the abutment 94 between the top and bottom 75 and 76. The contact face 94*a* is the most rearwardly-directed portion of the abutment 94.

Figure 4A:
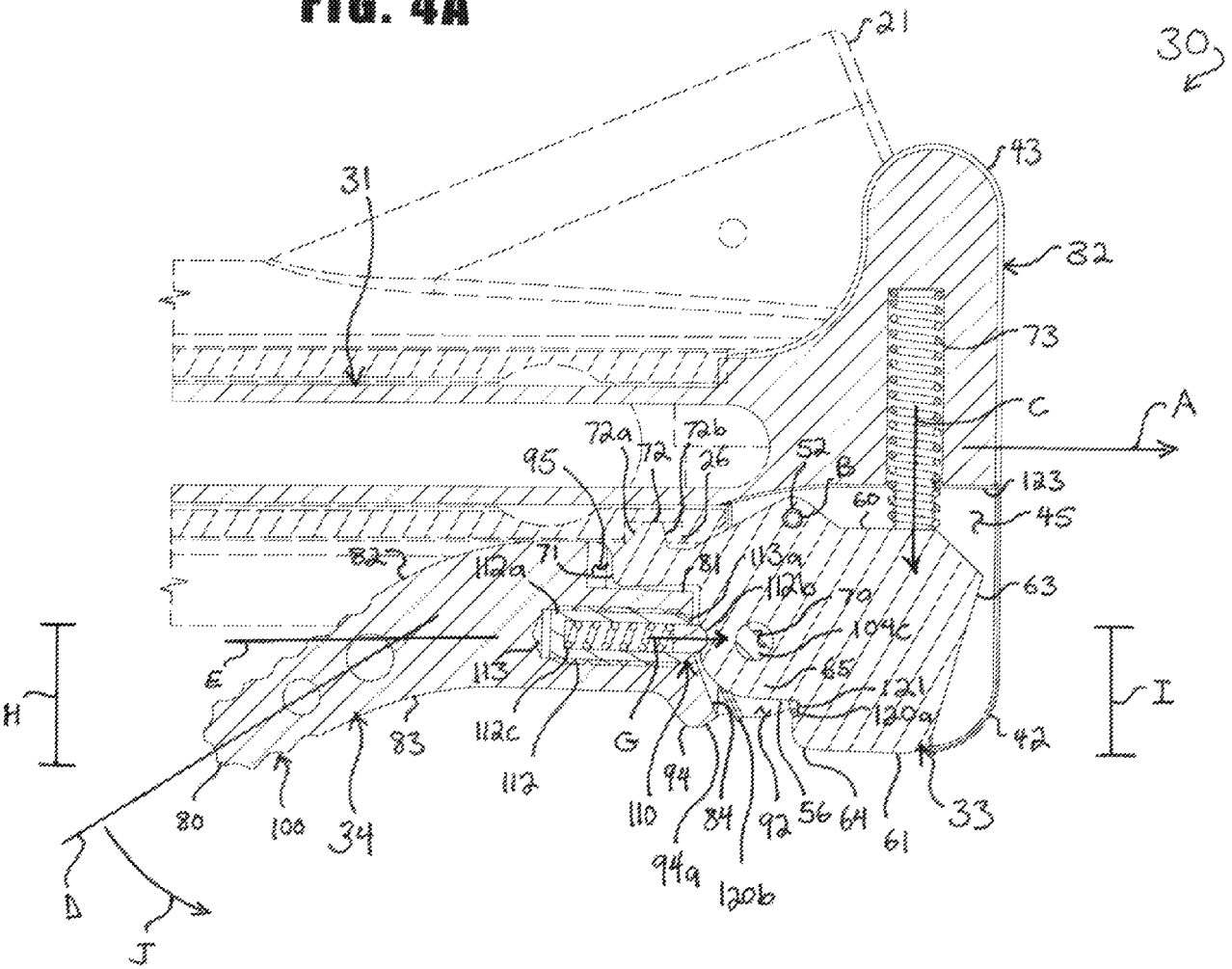
FIGS. 4A-4D are section views taken along the line 4-4 in FIG. 1C, showing a sequence of steps of moving the charging handle from the ready condition to the retracted condition.

With brief reference to FIG. 4A, on the inner side 82 of the lever 34, opposite the abutment 94, the lever 34 is formed with a slot 95 communicating with the pivot space 92. The slot 95 extends along the inner side 82 forwardly from the pivot space 92 to a location generally intermediate with respect to the front and rear ends 80 and 81. The slot 92 defines a latch-receiving space and is sized and shaped to receive the latch 71 carried on the fixture 33.

Referring back to FIG. 3, a grip 100 is disposed at the front end 80 of the lever 34. The peripheral edge 84 along the grip 100 has corrugations 101 to provide an enhanced gripping surface, and one having skill in the art will appreciate the grip 100 alternatively includes serrations, knurling, or another textured surface. Holes 102 and 103 are formed through the grip 100 from the top 75 to the bottom 76 to lower the weight and rotational inertia of the lever 34. The grip 100 is aligned along a line D and is aligned to the rail 31, as indicated in FIG. 4A, and a portion of the lever 34 between the rear end 81 and a location generally between the front and rear ends 80 and 81 is aligned along a line E in FIG. 4A. Line E is aligned generally longitudinally with respect to the upper receiver 21, as seen in FIG. 4A. Line D is offset from line E, so that the grip 100 is disposed acutely to the portion of the lever 34 between the rear end 81 and the location generally between the front and rear ends 80 and 81.

With continuing reference to the section view of FIG. 4A, the lever 34 is mounted for pivotal movement to the fixture 33 between a first, storage position and a second, deployed position with respect to the fixture 33. The pivot space 92 in the rear end 81 of the lever 34 is fitted over the fixture 33 and aligned with the bore 70 formed in the collar 65. A fastener 104, shown in FIG. 3, extends through the bores 70 and 93. The fastener 104 is a bolt, screw, or similar fastener, and has an enlarged head 104*a* and a shank 104*b* with a smooth proximal portion 104*c* and a threaded distal portion 104*d*. The threaded distal portion 104*d* of the fastener 104 is threadably secured in the threaded bore 93 in tab 91 and the head 104*a* is held against the top 75 of the lever 34 at the tab 91, with the smooth portion 104*c* of the shank 104*b* extending through the bore 93 in the tab 90 and through the bore 70 in the fixture 33. The fastener 104 defines an axis F, as indicated in FIG. 3, about which the lever 34 pivots.

In the first position of the lever 34, as shown in FIG. 4A, the lever 34 is against the latch 71. The latch 71 is received in the slot 95, and the latch 71 is generally aligned parallel with respect to line E of the lever 34. The fixture 33 and lever 34 carry an alignment assembly 110 to align the fixture 33 and lever 34 with respect to each other and to resist pivotal movement of the lever 33 out of the first position. The alignment assembly 110 acts to resist movement of the lever 34 out of the first position and then, once the lever 34 is out of the first position, the alignment assembly 110 allows further movement of the lever 34 between the first and second positions without resistance. The alignment assembly 110 includes a detent 111 in the fixture 33 and a pin 112 carried on the lever 34 for reciprocal movement into and out of the detent 112. Referring back to FIG. 3, the detent 111 is formed in the peripheral edge 56 of the fixture 33 directly in front of the bore 70. The detent 111 is a vertical, concave depression and extends into the collar 65 along the full height of the peripheral edge 56 between the top and bottom surfaces 54 and 55. When the lever 34 is in the first position with respect to the fixture 33, the pin 112 is aligned with the detent 111. Referring now to FIG. 4A, the pin 112 is threadably secured in a bore 113 extending into the rear end 81 of the lever 34. The bore 113 has an opening 113*a* communicating with the pivot space 92 and leading into the bore 113. The pin 112 has a hollow, cylindrical body 112*a* carrying a head 112*b* for reciprocal movement between an extended position projecting beyond the peripheral edge 84 of the lever 34 and a depressed position retracted with respect to the peripheral edge 84 of the lever 34. The head 112*b* is biased away from the body 112*a* into the extended position along the arrowed line G in FIG. 4A by a spring 112*c* compressed between the head 112*b* and the body 112*a*. The head 112*c* of the pin 112 is convex and is sized and shaped to be closely received in the detent 111 in the fixture 33. The convex shape of the head 112*c* of the pin 112 transfers forces applied laterally on the head 112*c* transversely into the body 112*b* opposing the spring 112*c* against the arrowed line G. In this way, lateral forces imparted by torque applied to the lever 34 to initially pivot the lever 34 out of the first position are directed inward to compress the spring 112*c* and depress the head 112*b*. Once out of the first position, the head 112*b* is depressed in sliding contact with the collar 65, so that no further force is required to move the lever 34 to the second position.

In the first position of the lever 34 and the extended position of the head 112*b*, the pin 112 is arranged in an interference fit with the detent 111. The head 112*b* is in the detent 111, and the lateral forces imparted by applied torque on the lever 34 which yield a higher decomposed inward force against the line G than the outward bias urged by the spring 112*c* move the head 112*b* inward from the extended position to the depressed position. In the depressed position of the head 112*b*, the alignment assembly 110 is disengaged, and the lever 34 is able to be moved out of the first position. As the head 112*b* depresses and moves out of the detent 111, the head 112*b* pops out of the detent 111 onto the peripheral edge 56, providing tactile feedback to the operator in the form of a vibration or short pulse, informing the operator that the lever 34 has been moved out of the first position. The tactile feedback is percussive and imparted in response to the mechanical sliding of the head 112*b* out of the detent 111.

As described, the alignment assembly 110 resists movement of the lever 34 away from the first position. Once the lever 34 is out of the first position, the alignment assembly 110 does not prevent or promote movement. Instead, the head 112*b* of the pin 112 moves in sliding contact against the peripheral edge 56 along the collar 65 until the pin 112 is again aligned with the detent 111 when the lever 34 is returned to the first position. A torsion spring 120, seen in FIG. 3, continually biases the lever 34 into the first position. The spring 120 is a helical spring and has opposed ends 120*a* and 120*b*. The end 120*a* is an elbow, or upstanding end, and the end 120*b* extends outward from the spring 120. The spring 120 encircles the smooth portion 104*c* of the shank 104*d* of the fastener and is located in the pivot space 92 between the bottom surface 55 of the fixture 33 and the tab 91 on the lever 34. The end 120*a* is received in the notch 121 formed between the abutment 64 and the collar 65 on the fixture 33, and the end 120*b* is received against the rear end 81 of the lever 34 within the pivot space 92. The spring 120 is compressed between the notch 121 and the rear end 81, and exerts a torsional bias on the fixture 33 and the lever 34, biasing the lever 34 into the first position thereof. The bias imparted by the spring 120 is less than the bias imparted by the spring 112*c* against the head 112*b* of the pin 112, so that a greater force is required to move the lever 34 out of the first position than is required to overcome the spring 120 biasing the lever 34 back into the first position. In this way, a larger force is required to initiate movement of the lever 34 out of the first position than is required to continue that movement from out of the first position to the second position of the lever 34, so that accidental catches of the lever 34 on gear are limited.

Though the spring 120 is a preferred means for biasing the lever 34 into the first position thereof, one having reasonable skill in the art will appreciate that other systems are suitable for such purpose, such as a compression spring disposed between the fixture 33 and the lever 34 on the outer sides 61 and 83 of the fixture 33 and the lever 34, respectively. Alternatively, magnetic attraction between the inner side 82 of the lever 34 and the rail 31 or the upper receiver 21 would bias the lever 34 into the first position. Likewise, though the alignment assembly 110 including the detent 111 and the pin 112 is a preferred means for resisting movement of the lever 34 out of the first position, one having reasonable skill in the art will appreciate that other systems are suitable for such purpose, such as magnetic attraction between the inner sides 60 and 82 of the fixture 33 and the lever 34, respectively. Alternatively, a releasable coupling, such as a hook-and-loop engagement assembly, carried by the fixture 33 and the lever 34, would resist movement of the lever 34 out of the first position.

In operation, the charging handle 30 is useful for quickly and easily cycling the bolt carrier group of the firearm so as to ready the firearm for firing. With reference now to FIG. 4A, which shows the charging handle 30 applied to the upper receiver 21, the lever 34 is in the first position, the fixture 33 is in the first position, and the latch 71 is engaged with the catch 26 of the upper receiver 21. The latch 71 is within the catch 26 and is biased into the catch 26 by the linear compression spring 73. In this condition, with the lever 34 and the fixture 33 each in the first position and the latch 71 lappingly engaged with the catch 26, the movement of the charging handle 30 is limited by the interaction of the catch 26 with the latch 30, and the charging handle 30 is in a lock condition and cannot be retracted toward the stock 24 in a direction along line A. In this lock condition, the inner side 82 of the lever 34 is held close to the upper receiver 21, but the grip 100 of the lever 34 is available to be gripped outboard of the upper receiver 21.

Figure 4B:
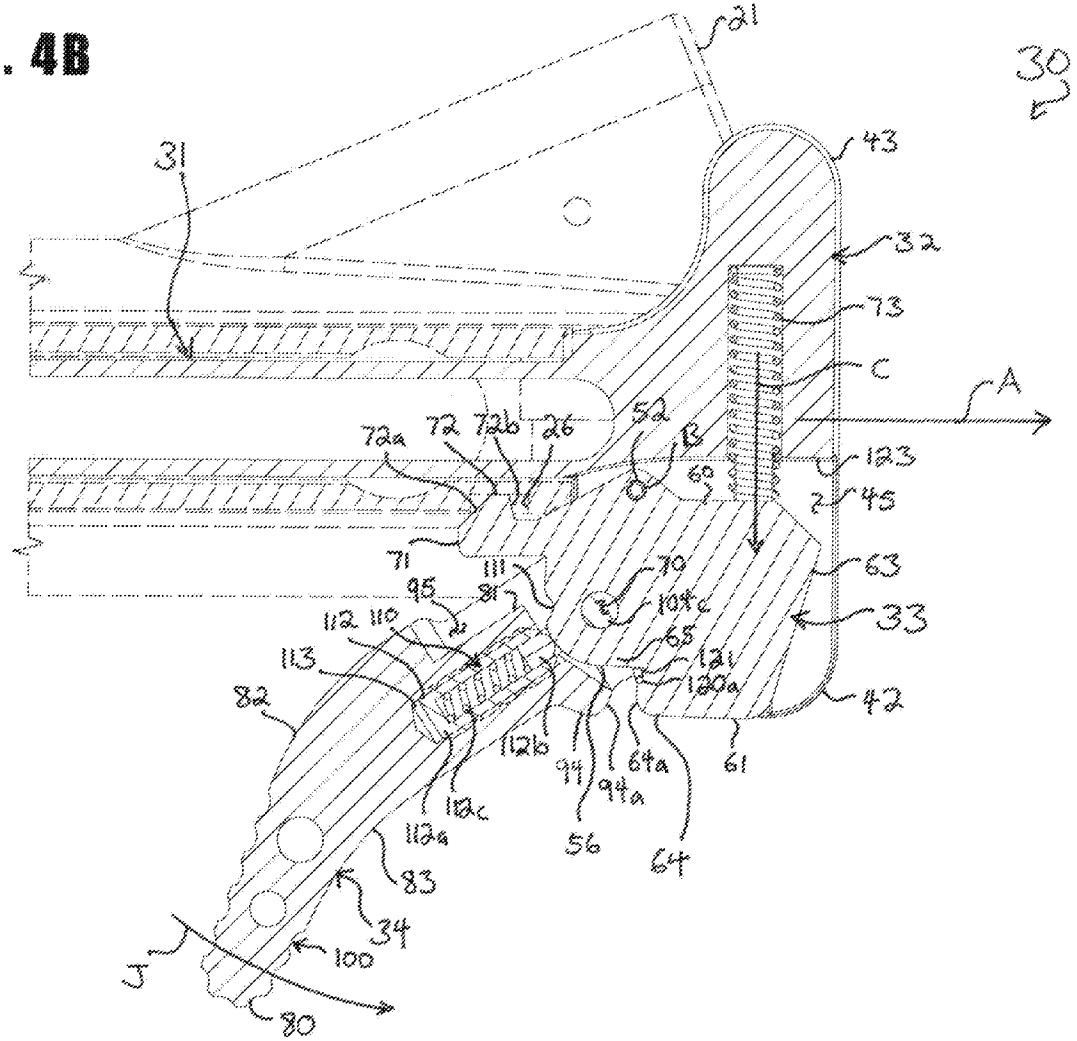

When the operator desires to cycle the bolt carrier group, the charging handle 30 must be retracted toward the stock 24. To do so, the operator grasps, as by the fingers, the grip 100 of the lever 34. The grip 100 extends just past the edge of the upper receiver 21 by a distance H, as indicated in FIG. 4A. The distance H is one of less than and marginally greater than a distance I, which is the distance that the side 42 of the head 32 of the charging handle 30 extends past the upper receiver 21, so that, when the charging handle 30 is in the locked condition, the lever 34 is inboard with respect to the side 42 of the head 32 and only the grip 100 of the lever 34 of the charging handle 30 is made available to be drawn back. The operator then pulls the lever 34 outward and toward the stock 24 along line J, as indicated in FIG. 4A. The operator applies sufficient torque on the lever 34 about the fastener 104 to overcome the bias urged by the spring 112*c* to move the head 112*b* of the pin 112 inward from the extend position to the depressed position, thereby depressing the pin 112 out of the detent 111 so that the lever 34 is free to move out of the first position, as shown in FIG. 4B. The force required to move the lever 34 out of the first position is less than the force required to compress the spring 73 so as to prevent compression of the spring 73 and movement of the fixture 33 while the lever 34 is being moved out of the first position. Until the lever 34 is moved into the second position, the lever 34 is decoupled from the fixture 33 and cannot impart movement to the fixture 33.

In FIG. 4B, the lever 34 is moved out of the first position, and the head 112*b* of the pin 112 is depressed into the body 112*a* and is in sliding contact with the peripheral edge 56 along the collar 65 of the fixture 33. The latch 71 remains engaged in the catch 26 preventing the charging handle 30 from being drawn back along line A toward the stock 24, but is now moved out of the slot 95 on the inner side 82 of the lever 34. The abutment 94 on the lever 34 is moved toward the abutment 64 on the fixture 33, but the abutment faces 94*a* and 64*a* are spaced apart from each other. The operator continues to draw the lever 34 back along line J to move the lever 34 into the second position thereof, as shown in FIG. 4C.

Figure 4C:
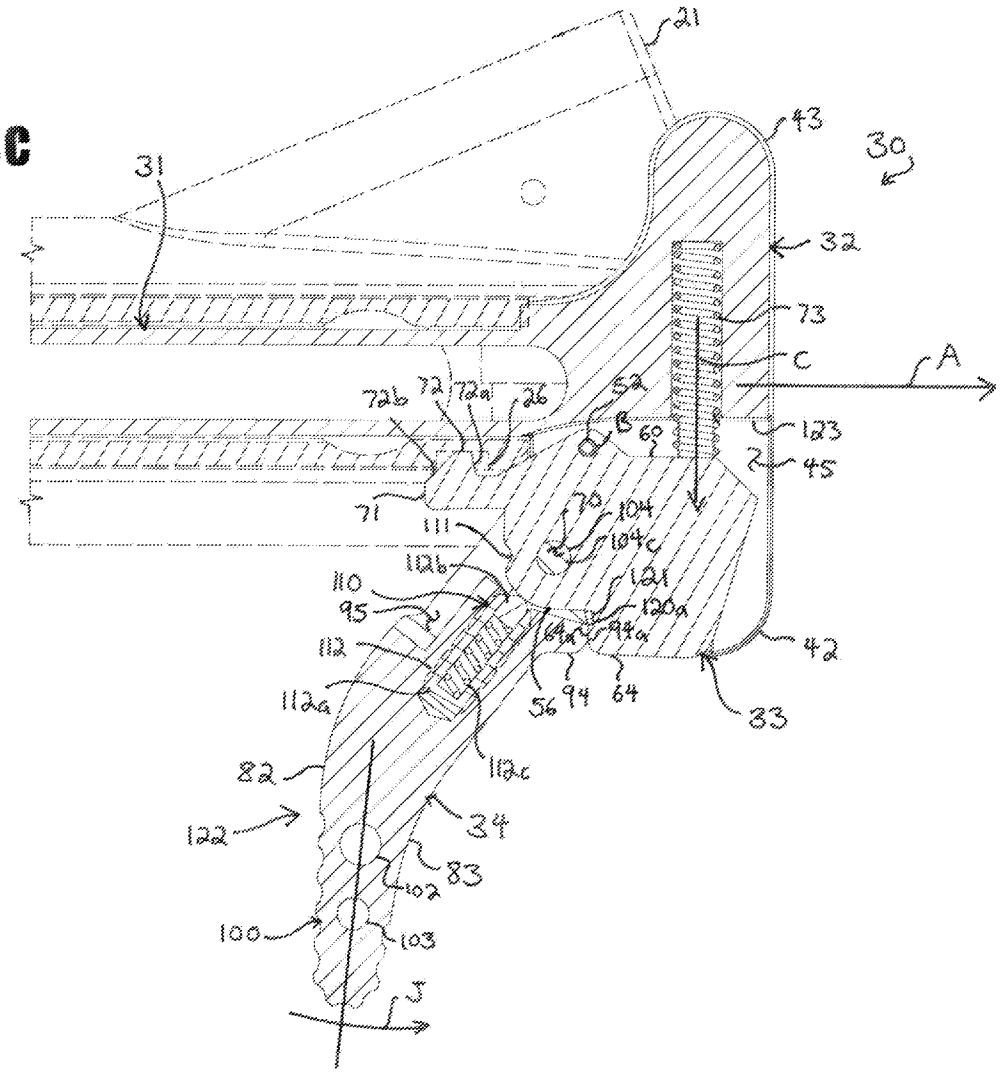

In FIG. 4C, the lever 34 is in the second position and the fixture 33 is in the first position. In the second position of the lever 34 and the first position of the fixture 33, the lever 34 is coupled to the fixture 33 in preparation to move the fixture 33 from the first position to the second position. The grip 100 of the lever 34 is aligned transversely and nearly perpendicularly to the rail 31 in the upper receiver 21, as indicated by line D in FIG. 4C. The abutment face 94*a* of the abutment 94 on the lever 34 is in direct contact against the abutment face 64*a* of the abutment 64 on the lever 34, coupling the lever 34 to the fixture 33 for pivotal movement of the fixture 33 with and in response to movement of the lever 34. In this way, the lever 34 extends outwardly from the head 32 and defines an elongate extension 122 of the head 32 available to be gripped by the operator for enhanced retraction of the charging handle 30. The latch 71 remains engaged in the catch 26, preventing the charging handle 30 from being drawn back along line A toward the stock 24. To now retract the charging handle 30 from the upper receiver 21, the lever 34 is pulled back along line J as shown in FIG. 4C. The interaction of the abutment 94 on the lever 34 with the abutment 64 on the fixture 33 imparts pivotal movement to the fixture 33 in response to the movement of the lever 34 along the line J about the fastener 104. The fixture 33 pivots about axis B through the gudgeon pin 52, compressing the spring 73. Movement of the fixture 33 is continued until the inner side 60 of the fixture 33 is proximate to an inner wall 123 of the slot 45 formed in the head 32 between the sides 42 and 43, and the fixture 33 is in the second position, as shown in FIG. 4D.

Figure 4D:
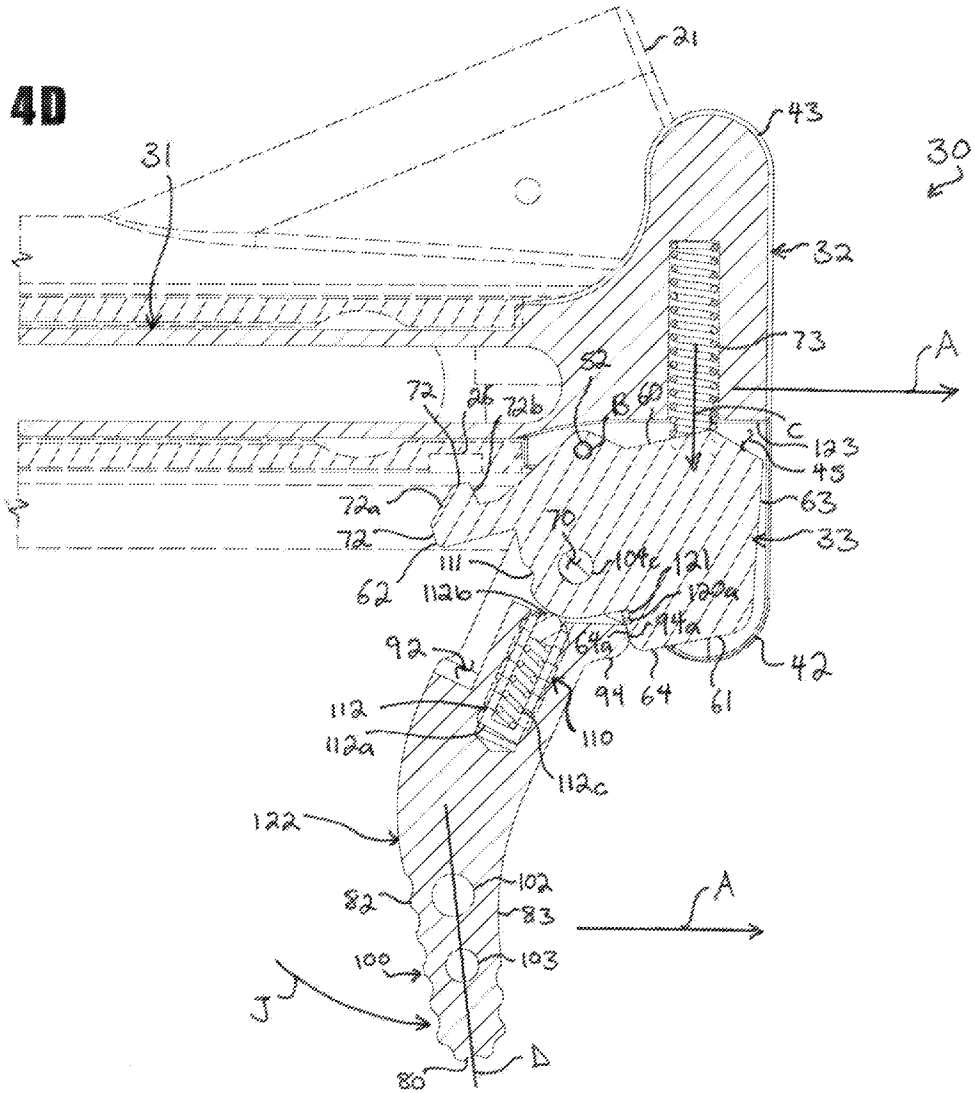

In FIG. 4D, the lever 34 is in the second position thereof and the fixture 33 is in the second position thereof. In the second position of the fixture 33, the latch 71 is moved out of the catch 26 in the upper receiver 21, and the head 72 is free to move out of the upper receiver 21, defining a release condition of the latch 71 and the fixture 33. The inner side 60 of the fixture 33 is proximate to the inner wall 123 of the slot 45 formed in the head 32 between the sides 42 and 43. The abutments 94 and 64 remain in contact with each other. The lever 34 is extended outwardly along line D nearly perpendicularly with respect to the rail 31 and the upper receiver 21, maintaining the elongate extension 122 of the head 32 for enhanced retraction of the charging handle 30. The operator now retracts the charging handle 30 out of the upper receiver 21 toward the stock 24 of the firearm by continuing to grasp the lever 34 and pull back along line A. In this way, the charging handle is retracted along the upper receiver 21 toward the stock 24. Although the process of retracting the charging handle 30 is described above as a series of sequential steps, one having skill in the art will understand and appreciate that it is preferably accomplished in a single, continuous, fluid motion of pulling the lever 34, taking approximately one second.

Once the charging handle 30 has been retracted, the charging handle 30 is released. The charging handle 30 is returned forward within the upper receiver 21 as shown in FIGS. 1A and 1C in a conventional and well-known fashion. The linear compression spring 73 urges the fixture 33 from the second position to the first position. The front 72*a* of the latch 71 that is oblique with respect to the rail 31 slides over and into the catch 26 in response to the charging handle 30 returning to within the upper receiver 21. Once received in the catch 26, the latch 71 limits retraction of the charging handle 30 by interaction with the catch 26. The torsion spring 120 urges the lever 34 back to the first position thereof, and the alignment assembly 110 aligns the lever 34 in the first position, securing the lever 34 and fixture 33 with respect to each other. In this way, the lever 34 is proximate to the upper receiver 21 and to the rail 31 in a low-profile arrangement and is not available to be caught upon gear or equipment.

The present invention has been described above as including a fixture 33 and lever 34 disposed on the left-hand side of the firearm 20 and, as such, is useful for an operator using his right hand for depressing the trigger of the firearm to grip and cycle the charging handle 30 with his left hand. One having skill in the art will understand that the charging handle alternatively includes a fixture 33 and lever 34 on the opposite, right-hand side of the firearm 20. In this way, the charging handle is useful for an operator who shoots with his left hand to grip and cycle the charging handle with his right hand.

The present invention is described above with reference to a preferred embodiment. However, those skilled in the art will recognize that changes and modifications may be made in the described embodiment without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A firearm charging handle comprising:
a rail formed integrally with a head;
a fixture pivoted to the head for movement between a first position and a second position, the fixture formed with a latch;
in the second position of the fixture, the latch is in a release condition;
a lever pivoted to the fixture for movement between a first position and a second position with respect to the fixture;
in the second position of the lever, the lever is coupled to the fixture to move the fixture from the first position to the second position thereof; and
means resisting movement of the lever out of the first position thereof, wherein the means comprises:
a detent formed on one of the fixture and the lever;
a pin carried on the other of the fixture and the lever for movement into and out of the detent; and
in the first position of the lever, the pin is biased into the detent to resist lateral movement out of the detent.

2. The firearm charging handle of claim 1, wherein in the first position of the lever, the lever is proximate to the rail.

3. The firearm charging handle of claim 1, wherein:
the head has a side; and
in the first position of the lever, the lever is inboard with respect to the side.

4. The firearm charging handle of claim 1, further comprising means biasing the lever into the first position.

5. The firearm charging handle of claim 1, wherein the lever imparts tactile feedback in response to the lever moving out of the first position.

6. The firearm charging handle of claim 1, further comprising means biasing the lever into the first position,
wherein the means resisting movement of the lever out of the first position exerts a greater force than the means biasing the lever into the first position.

7. A firearm charging handle comprising:
a rail formed integrally with a head;
a fixture pivoted to the head for movement between a first position and a second position, the fixture formed with a latch;
in the second position of the fixture, the latch is in a release condition;
a lever pivoted to the fixture for movement between a first position and a second position with respect to the fixture;
means resisting movement of the lever out of the first position thereof, wherein the means comprises:
a detent formed on one of the fixture and the lever; and
a pin carried on the other of the fixture and the lever for movement into and out of the detent;
in the first position of the lever, the lever is proximate to the rail, and the pin is biased into the detent to resist lateral movement out of the detent;
in the second position of the lever, the lever is coupled to the fixture to move the fixture from the first position to the second position thereof; and
in the second position of the lever and the second position of the fixture, the lever extends outwardly from the head.

8. The firearm charging handle of claim 7, wherein:
the lever includes a grip;
in the first position of the lever and the first position of the fixture, the grip of the lever is disposed proximate to the rail; and
in the second position of the lever and the second position of the fixture, the grip of the lever is transverse with respect to the rail.

9. The firearm charging handle of claim 7, wherein:
the head has a side; and
in the first position of the lever and the first position of the fixture, the lever is inboard with respect to the side.

10. The firearm charging handle of claim 7, further comprising means biasing the lever into the first position.

11. The firearm charging handle of claim 7, further comprising means biasing the lever into the first position,
wherein the means resisting movement of the lever out of the first position exerts a greater force than the means biasing the lever into the first position.

12. The firearm charging handle of claim 7, wherein the lever imparts tactile feedback in response to the lever moving out of the first position.

13. A firearm charging handle comprising:
a rail formed integrally with a head;
a fixture pivoted to the head for movement between a first position and a second position, the fixture formed with a latch;
in the second position of the fixture, the latch is in a release condition;
a lever pivoted to the fixture for movement between a first position and a second position with respect to the fixture;
means resisting movement of the lever out of the first position thereof comprising:
a detent formed on one of the fixture and the lever; and
a pin carried on the other of the fixture and the lever for movement into and out of the detent;
in the first position of the lever, the lever is proximate to the rail, and the pin is biased into the detent to resist lateral movement out of the detent; and
in the second position of the lever, the lever is in abutment with the fixture to move the fixture from the first position to the second position thereof.

14. The firearm charging handle of claim 13, wherein:
the lever includes a grip;
in the first position of the lever and the first position of the fixture, the grip of the lever is aligned with the rail; and
in the second position of the lever and the second position of the fixture, the grip of the lever is transverse with respect to the rail.

15. The firearm charging handle of claim 13, wherein:
the head has a side; and
in the first position of the lever and the first position of the fixture, the lever is inboard with respect to the side.

16. The firearm charging handle of claim 13, further comprising means biasing the lever into the first position,
wherein the means resisting movement of the lever out of the first position exert a greater force than the means biasing the lever into the first position.

17. The firearm charging handle of claim 13, further comprising:

an abutment formed on the fixture;

an abutment formed on the lever; and in the second position of the lever, the abutment formed on the lever is against the abutment formed on the fixture.

18. The firearm charging handle of claim 13, wherein the lever imparts tactile feedback in response to the lever moving out of the first position.

* * * * *